US005299943A

United States Patent [19]

Shieh

[11] Patent Number: 5,299,943

[45] Date of Patent: Apr. 5, 1994

[54] CLOSED TYPE BUILT-UP RECEPTACLE ASSEMBLY

[76] Inventor: Jen-Huei Shieh, 4F, No. 23, Lane 326, Yung Ji Road, Taipei, Taiwan

[21] Appl. No.: 903,211

[22] Filed: Jun. 23, 1992

[51] Int. Cl.[5] ..... H01R 13/447; H01H 9/02

[52] U.S. Cl. ..... 439/136; 439/540; 174/53; 174/67

[58] Field of Search ..... 174/52.1-52.3, 174/53, 66, 67; 439/135, 136, 145, 540; 220/3.8, 3.94

[56] References Cited

U.S. PATENT DOCUMENTS

| | | | |
|---|---|---|---|
| 3,865,456 | 2/1975 | Dola | 174/67 X |
| 4,188,082 | 2/1980 | Dickey | 439/145 |
| 4,993,962 | 2/1991 | Noda et al. | 439/136 |
| 5,161,988 | 11/1992 | Krupka | 439/136 |

FOREIGN PATENT DOCUMENTS

| | | | |
|---|---|---|---|
| 1249049 | 1/1989 | Canada | 174/67 |
| 150677 | 9/1981 | Fed. Rep. of Germany . | |

*Primary Examiner*—Mark Rosenbaum
*Assistant Examiner*—S. Thomas Hughes
*Attorney, Agent, or Firm*—Lowe, Price, LeBlanc & Becker

[57] ABSTRACT

A closed type built-up receptacle assembly comprised of at least one receptacle retained inside a hole on a wall by a mounting plate, and a face panel covered on said mounting plate, wherein each receptacle is comprised of a receptacle body supported on a compression spring and held in a casing by a holder, a covering covered on the casing over the receptacle body, and two movable plates controlled by torsional springs to close the opening on the covering and the plug hole on the receptacle body.

3 Claims, 6 Drawing Sheets

CLOSED TYPE BUILT-UP RECEPTACLE ASSEMBLY

BACKGROUND OF THE INVENTION

The present invention relates to sockets, and more particularly, the present invention relates to a closed type built-lip receptacle assembly.

A variety of receptacles are known and widely in use. In these conventional receptacles, the plug hole(s) is (are) constantly opened for connecting a plug or plugs. Because the plug hole(s) is (are) exposed to the outside, the internal electric circuit of a receptacle may be damped easily causing short circuit problem.

SUMMARY OF THE INVENTION

The present invention has been accomplished to eliminate the aforesaid problem. According to the preferred embodiment of the present invention, a closed type built-up receptacle assembly as constructed in accordance with the present invention is generally comprised of a plurality of receptacles, a mounting plate, and a face panel covered on the mounting plate. The face panel is connected to the mounting plate through a hooked joint. The mounting plate is fastened to the wall to hold the at least one receptacle in a hole on the wall. Each receptacle is comprised of a receptacle body supported on a compression spring and held in a casing by a holder, a covering covered on the casing over the receptacle body, two movable plates controlled by torsional springs to close the opening on the covering and the plug hole on the receptacle body. The first movable plate has a key projecting into the opening on the covering for lifting control, and two notches on two opposite top covered thereof. Lifting the key causes the two notches of the first movable plate to respectively match with two projecting rods on the second movable plate, and therefore the second movable plate is carried by the first movable plate upward in opening the plug hole on the respective receptacle body. Releasing the key causes the torsional spring to move the first and second movable plates back into their original positions in closing up the plug hole.

DETAILED DESCRIPTION OF THE PREFERRED EMBODIMENT

Figure 5:
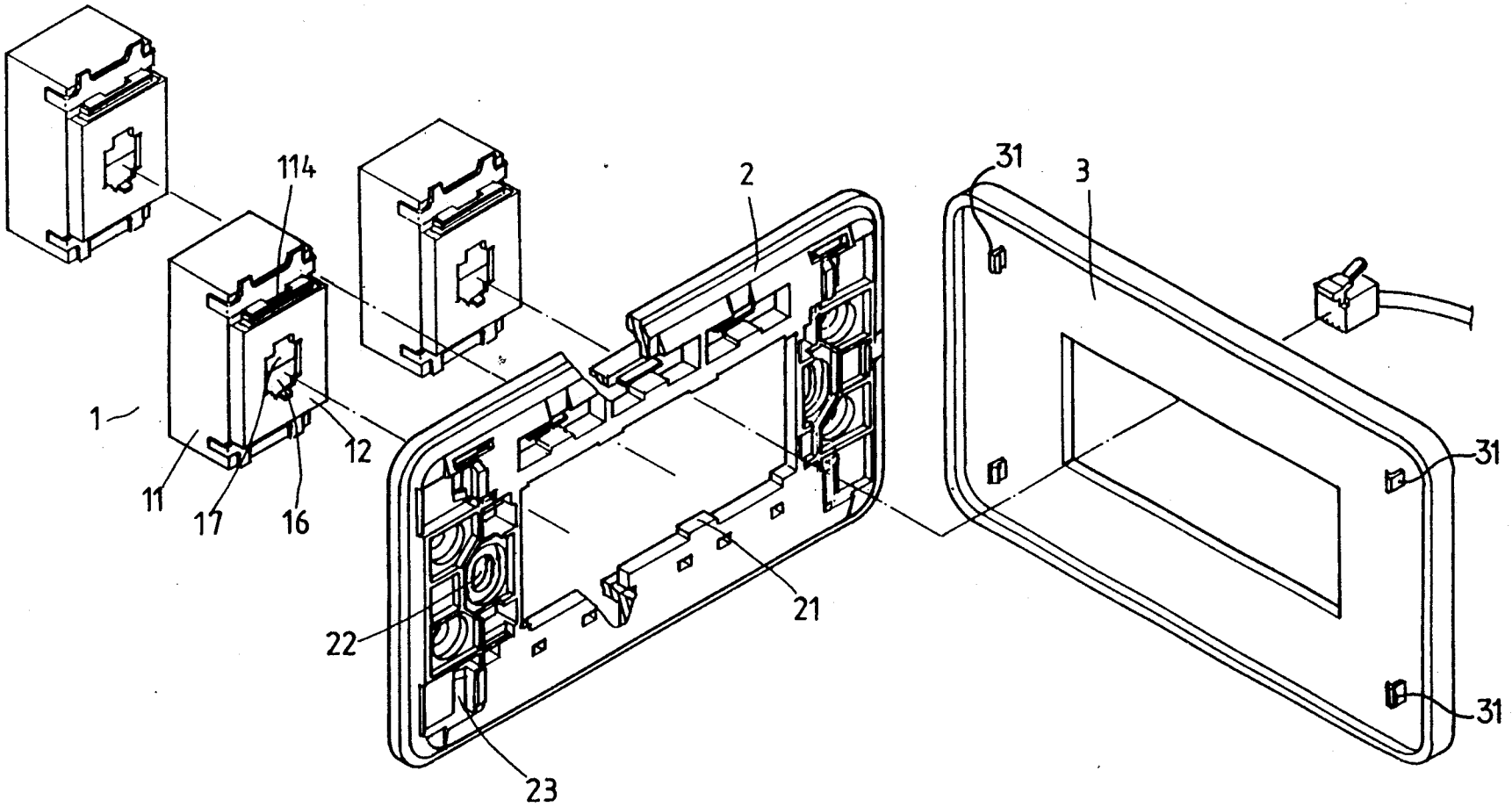
FIG. 5 is an exploded view of a receptacle assembly according to the present invention.
Figure 6:
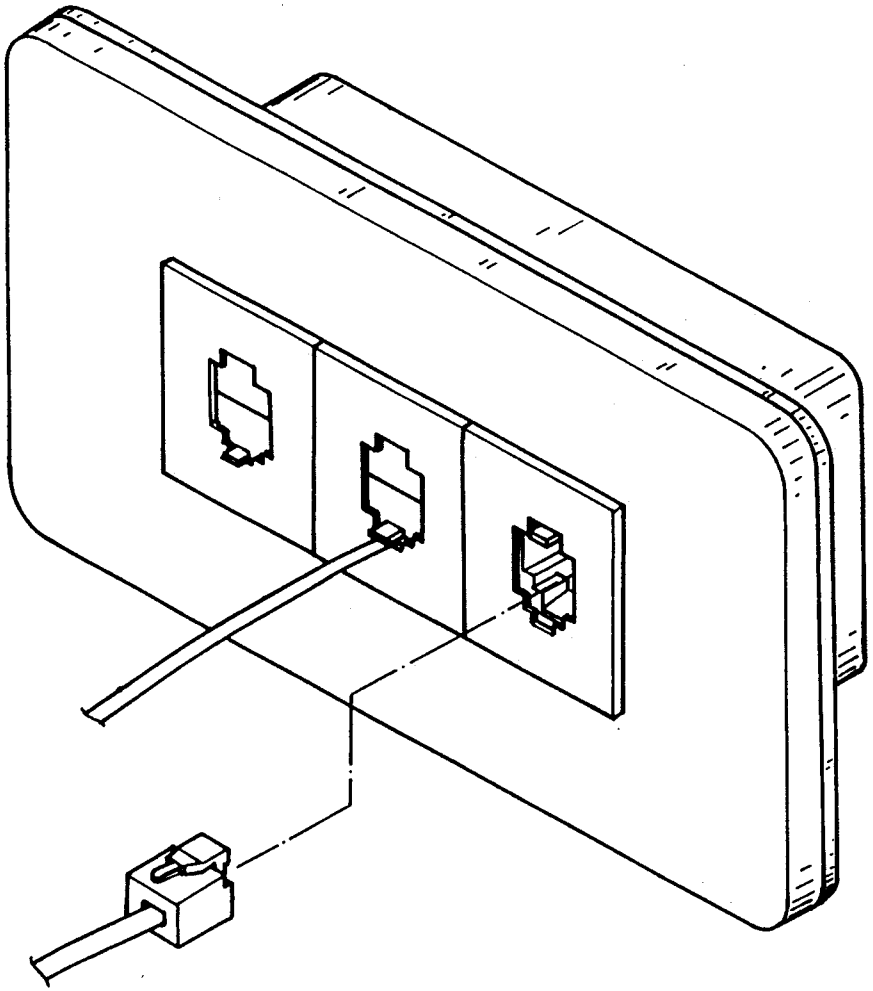
FIG. 6 is an elevational view of the receptacle assembly of FIG. 5.

Referring to FIG. 5, a closed type built-up receptacle assembly as constructed in accordance with the present invention is generally comprised of a plurality of receptacles 1, a mounting plate 2 and a face panel 3.

Figure 1:
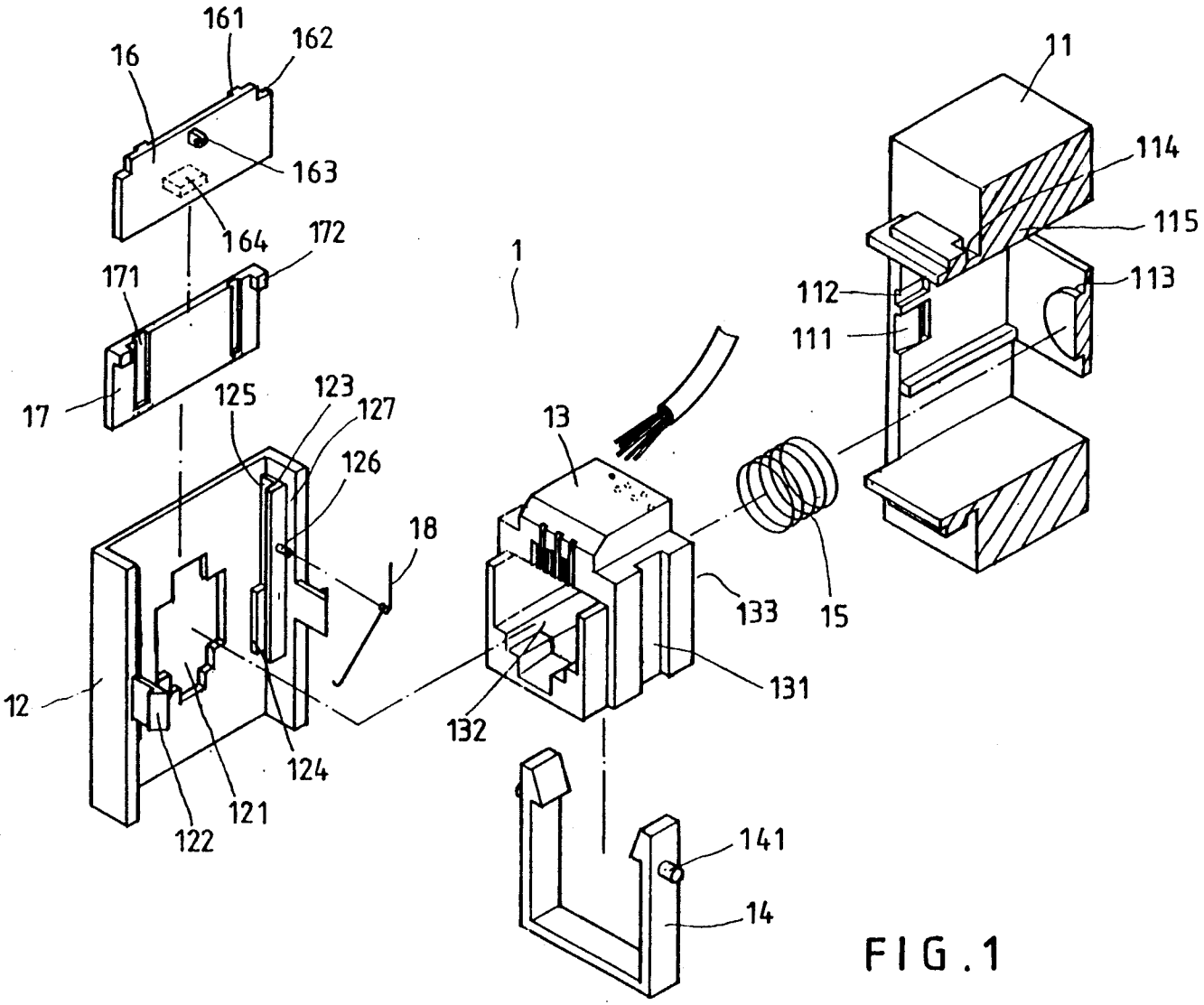
FIG. 1 is an exploded view of a receptacle according to the present invention.
Figure 2:
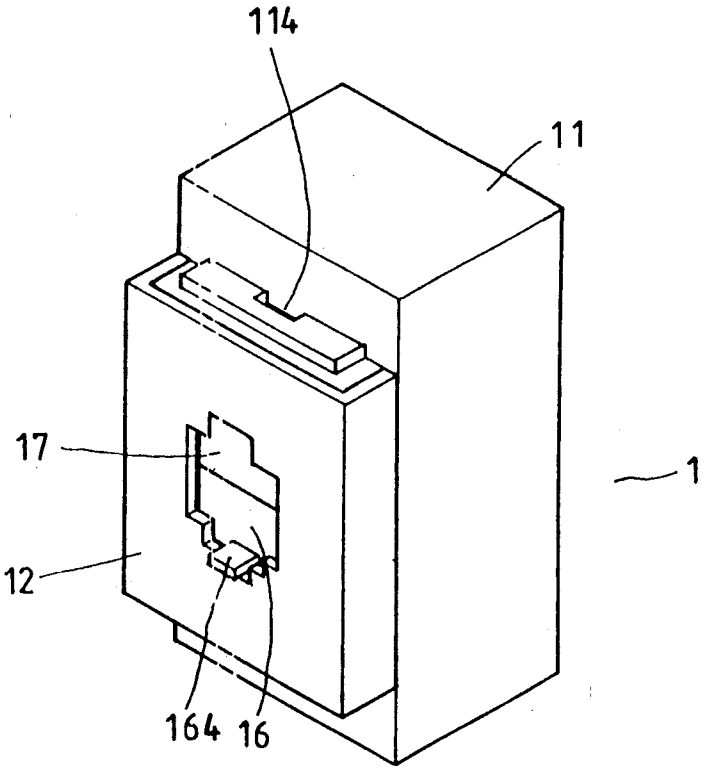
FIG. 2 is an elevational view of the receptacle of FIG. 1.

Referring to FIGS. 1 and 2, a receptacle 1 is consisted of a casing 11, a covering 12, a receptacle body 13, a substantially U-shaped holder 14, a compression spring 15, a first movable plate 16, a second movable plate 17, and two torsional springs 18. The casing 11 comprises two recessed retaining holes 111 and two elongated grooves 112 on the two opposite side walls thereof on the inside, a circular projection 113 on the back wall thereof on the inside, and two opposite horizontal grooves 114 on two front horizontal walls thereof. The receptacle body 13 (which is a modular jack in this embodiment) comprises two elongated grooves 131 vertically made on two opposite side walls thereof into which the two opposite ends of the U-shaped holder 14 are inserted, a plug hole 132 into which a plug may be inserted, and a circular projection 133 on the back wall thereof. The U-shaped holder 14 has two opposite side pins 141 respectively inserted in the elongated grooves 112 to hold the receptacle body 13 inside the casing 11 permitting the compression spring 15 to be held between the circular projection 113 on the casing 11 and the circular projection 133 on the receptacle body 13. The covering 12 which is covered on the casing 11 to hold the receptacle body 13 inside the casing 11 comprises an opening 121 alinged with the plug hole 132 on the receptacle body 13, two opposite hooks 122 respectively hooked in the two recessed retaining holes Ill, two elongated, L-shaped plates 123 on the two opposite side walls thereof on the inside with two vertical sliding ways 125 respectively defined therebetween, two elongated strips 124 on the L-shaped plates 123 on the inside, two pins 126 on the L-shaped plates 123 on the outside onto which the two torsional springs 18 are mounted. The second movable plate 17 which is bridged over the two elongated strips 124 and moved to slide in the two sliding ways 125 comprises two parallel sliding grooves 171, and two projecting rods 172 at two opposite top corners thereof. The first movable plate 16 comprises two projecting blocks 161 spaced on the outside surface thereof at locations corresponding to the two sliding grooves 171 on the outer movable plate 17, a key 164 on the outside surface thereof between the two projecting blocks 161, two opposite notches 162 on the two opposite top corners thereof, and a lug 163 on the inside thereof thereof at the middle. The two torsional springs 18 are respectively mounted on the two pins 126, having each one end stopped against an inside surface 127 of the casing and an opposite end connected to the lug 163 on the first movable plate 16.

Referring to FIG. 5 again, the mounting plate 2 comprises two symmetrical rows of projecting strips 21 respectively inserted into the two opposite horizontal grooves 114 on each receptacle body 1, two through holes 22 through which fastening elements are inserted to fasten the mounting plate 2 to the wall, and a plurality of retaining holes 23 for fastening the face panel 3. The face panel 3 comprises a plurality of hooks 31 respectively hooked in the retaining holes 23 on the mounting plate 2.

Figure 4:
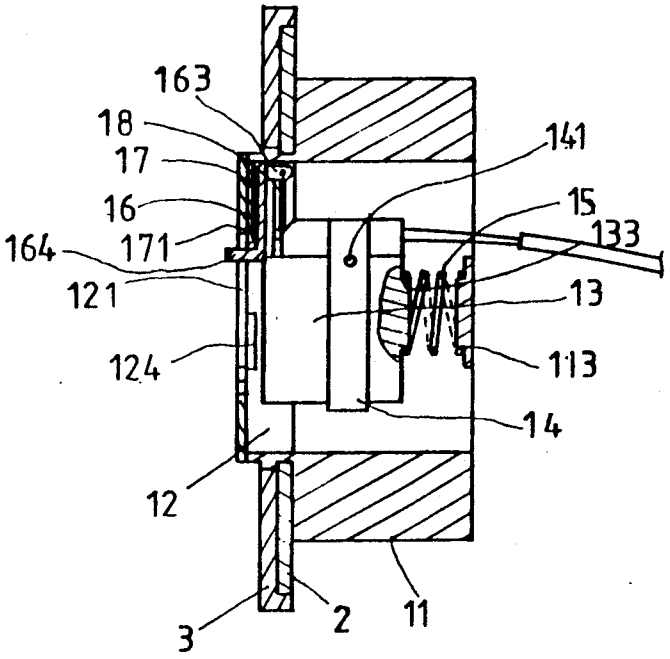
FIG. 4 is another sectional plain view showing that the first and second movable plates have been lifted to open the receptacle body into "operative position"
Figure 3:
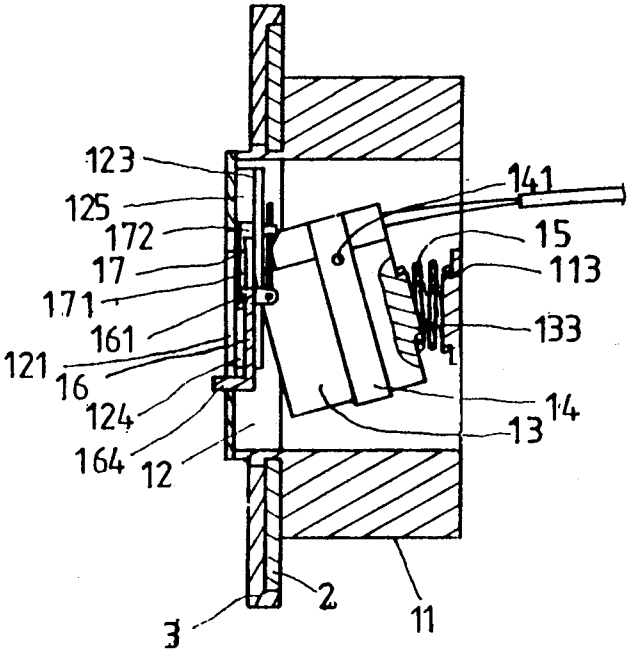
FIG. 3 is a sectional plain view showing that the receptacle body has been closed by the first and second movable plates and retained at "non-operative position"

Referring to FIGS. 2 and 3, pushing the key 164 inwards upwards causes the projecting blocks 161 of the first movable plate 16 to slide along the sliding grooves 171 in squeezing the torsional springs 18. Once the two opposite notches 162 on the first movable plate 16 are respectively matched with the two projecting rods 172 on the second movable plate 17, the second movable plate 17 will be carried by the first movable plate 16 to move upward from the opening 121 of the covering 12. When opened, the receptacle body 13 is squeezed by the first movable plate 16 and turned from "non-operative position" (see FIG. 3) to "operative position" (see FIG. 4). Once the receptacle body 13 has been turned to "operative position", the plug hole 132 is aligned with the opening 121 for connecting a plug. When not in use or the plug has been removed from the receptacle body 13, the torsional springs 18 immediate move the first movable plate 16 to carry the second movable plate 17 back to their original positions in closing the opening 121 of the covering 12 (see FIGS. 2 and 3).

Figure 7:
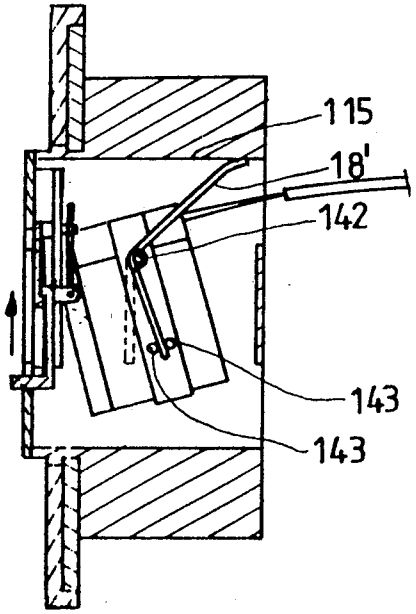
FIG. 7 is a sectional plain view of an alternate form of the present invention.

Referring to FIG. 7, therein illustrated is an alternate embodiment wherein torsional springs 18' replace compression spring 15. In this alternate arrangement, the U-shaped holder 14 has two opposite pairs of side pins 142,143 at two opposite sides for fastening the torsional springs 18. The torsional springs 18 are respectively mounted on one pair of side pins 142 with one end thereof respectively stopped against the other pair of side pins 143 and an opposite end thereof respectively stopped against an inside top edge 115 of the casing 11.

What is claimed is:

1. A closed type built-up receptacle assembly comprised of at least one receptacle retained inside a hole on a wall by a mounting plate, and a face panel covering said mounting plate wherein: each of said at least one receptacle comprising: a hollow casing, said casing including internal side walls having two recessed retaining holes and two retaining grooves on two opposite of said side walls an internal back wall having a circular projection thereon, and two front horizontal walls having opposed horizontal grooves thereon; a receptacle body received inside said casing, said receptacle body having two elongated grooves vertically disposed on two opposite side wall thereof, a plug hole therethrough into which a plug may be inserted, and a circular projection on a back wall thereof; U-shaped holder fitted into the two elongated grooves on said receptacle body for holding said receptacle body within said casing, said U-shaped holder having two opposite side pins thereon, respectively inserted in the two retaining grooves on said casing; bias means retained between said casing and said receptacle body, said bias means being connected between the circular projection on said casing and the circular projection on said receptacle body; a covering on said casing over said receptacle body, said covering defining an opening through which a plug may be inserted into the plug hole on said receptacle body, two hooks respectively hooked in recessed retaining holes on said casing, two elongated, L-shaped plates on two opposite side walls thereof on the inside with two vertical sliding ways respectively defined therebetween, two elongated strips and two pins on said L-shaped plates; a first movable plate inserted to slide in the sliding ways on said covering and controlled to close or open the opening of said covering, said first movable plate comprising two projecting blocks spaced on an outside surface thereof, a key projected into the opening of said covering for lifting control, two opposite notches on two opposite top corners thereof, and a lug on an inside surface thereof; two torsional springs respectively mounted on the pins on the L-shaped plates of said covering for urging said first movable plate to close the opening on said covering, said torsional springs having each one end connected to the lug on said first movable plate and an opposite end stopped against an inside surface on said covering; a second movable plate movably inserted to slide in the sliding ways on said covering and bridged over the two elongated strips on the L-shaped plates of said covering, said second movable plate having two sliding grooves in which the two projecting blocks of said first movable plate may slide, and two projecting rods at two opposite top corners thereof;

said mounting plate comprises two symmetrical rows of projecting strips respectively inserted into the two opposite horizontal grooves on each receptacle body, and a plurality of retaining holes; and said face panel including a plurality of hooks respectively hooked in the retaining holes on said mounting plate.

2. The closed type built-up receptacle assembly according to claim 1, wherein the two projecting rods of said second movable plate are respectively engaged in two notches on said first movable plate to stop said first movable plate during its up stroke.

3. The closed type built-up receptacle assembly according to claim 1, wherein said U-shaped holder further comprises, mounted on opposite sides thereof, a second pair of side pins and two third pairs of side pins and said bias means comprises a pair of torsional springs each torsional spring being supported on one of said second pair of side pins with one end thereof respectively stopped against one of said third pairs of side pins and an opposite end stopped against an inside top edge on said casing.

* * * * *